United States Patent [19]

Cope et al.

[11] 4,428,631

[45] Jan. 31, 1984

[54] COMPUTER KEY-PUNCH WORK-STATION HAVING ADJUSTABLE COPY SUPPORT-SHELF

[75] Inventors: Raymond Cope; Michael King, both of Birmingham, Ala.

[73] Assignee: Health Science Products, Inc., Birmingham, Ala.

[21] Appl. No.: 327,794

[22] Filed: Dec. 7, 1981

[51] Int. Cl.[3] ..... A47B 21/00; A47B 63/00

[52] U.S. Cl. ..... 312/194; 312/196; 312/208; 312/233; 312/255; 108/32

[58] Field of Search ..... 312/194, 195, 196, 233, 312/208, 313, 255, 232, 107; 297/170, 171, 172, 297/173; 108/32

[56] References Cited

U.S. PATENT DOCUMENTS

| | | | |
|---|---|---|---|
| Re. 16,410 | 8/1926 | Woolman | 312/313 |
| 436,642 | 9/1890 | Towle | 312/232 |
| 702,035 | 6/1902 | Shaffer | 108/32 |
| 841,766 | 1/1907 | Campbell | 312/255 |
| 1,256,218 | 2/1918 | Foster | 312/233 |
| 1,334,426 | 3/1920 | Winter | 312/313 |
| 1,475,889 | 11/1923 | Russell | 312/233 |
| 1,849,726 | 3/1932 | Reed | 312/208 |
| 2,223,405 | 12/1940 | Cain | 312/194 |
| 2,329,029 | 9/1943 | Bargen et al. | 312/233 |
| 2,673,132 | 3/1954 | Alderman | 312/107 |
| 2,931,685 | 4/1960 | Butler | 312/196 |
| 2,961,282 | 11/1960 | Close | 312/255 |
| 3,063,770 | 11/1962 | Hale et al. | 312/255 |
| 3,276,399 | 10/1966 | Canfield | 312/196 |
| 3,635,174 | 1/1972 | Ball et al. | 312/194 |
| 3,778,125 | 12/1973 | Gutmann, Jr. et al. | 312/208 |
| 3,887,057 | 6/1975 | Stahl et al. | 312/208 |
| 3,938,766 | 2/1976 | Herbolsheimer et al. | 312/208 |
| 4,313,112 | 1/1982 | Foster | 312/208 |

*Primary Examiner*—Victor N. Sakran
*Attorney, Agent, or Firm*—William T. Hough

[57] ABSTRACT

In a preferred embodiment, a computer key-punch work-station structure having a copy support shelf mounted behind a key board shelf's forward portion and above a rearward portion thereof, mounted adjustably of height at its rearward edge and thereby varable of tilt of the copy support shelf, and a video display-screen support shelf being mounted behind the copy support shelf and being adjustable of both height and tilt angle. This combination is mounted on bilateral unified leg structures having separate forward and rearward upright legs connected at their bases and connected at their upper portions by a horizontal weight-distributing support, with the tops of the leg structures being braced against sideward wobbling.

11 Claims, 2 Drawing Figures

COMPUTER KEY-PUNCH WORK-STATION HAVING ADJUSTABLE COPY SUPPORT-SHELF

This invention relates to an improved computer key-punch work-station.

BACKGROUND TO THE INVENTION

Prior to the present invention there has been experienced considerable difficulty arising from inadequate placement of the copy support shelf relative to both height and tilt such that under varying lighting conditions considerable glare has resulted to the reader or key board worker. The height of the worker, together with the positioning of overhead or laterally-located lighting has accordingly been accompanied with difficulties in speed-reading while concurrently attempting to punch the keys. Such problems are accentuated by the positioning of the copy support shelf above a rearward portion of the key board.

Also, because of considerable differences in sizes and shapes of different read-out screen monitors, the position of the screen as viewed above and behind each of the key punch board and the copy support shelf has proven to be inadequate for many of these various monitors, in so far as being conveniently visible and readable and devoid of glare as viewed by the key punch worker.

Because of the fact that these read-out screen monitors weight up to about 100 pounds, and are mounted rearwardly of the key punch board support shelf and the copy support shelf, structural support problems are encountered in table-like support structures intended to support such off-center weight, together with the lighter-weight forwardly-positioned key punch board and copy support shelf.

Also, because of the large weights of these monitors, further problems have been encountered and overcome in effecting variable heights with concurrent continuing support in the present invention.

From preceding notations, it is apparent that prior work stations of this sort have been inflexible and plagued with problems, together with being large bulky and unsightly structures, an important consideration to the commercial market in so far as acceptance and saleability.

SUMMARY OF THE INVENTION

Accordingly, objects of the present invention include the overcoming or avoiding of problems and difficulties and disadvantages of the types noted-above.

Another object, more particularly, is to obtain a computer key-punch work-station structure having a copy-support shelf variable in height and/or tilt to avoid glare and to achieve flexibility in positioning of copy material to suit the needs of individual key-punch workers.

Another object is to obtain a computer key-punch work-station structure having a screen-monitor support shelf variable in height and/or tilt to avoid glare and to achieve flexibility in positioning for improved viewing and positioning relative to the needs of the individual key-punch workers.

Another object is to achieve one or more prior objects while achieving structural support stability in so far as achieving the desired and needed positioning and height adjustability.

Another object is to achieve a aesthetically pleasing appearance while concurrently achieving improved leg-support having structural stability both in regard to rearward location of the heavy monitors, as well as the support and preferred positioning of each of the key-punch support shelf and the copy support shelf and the rearwardly-positioned monitor-support shelf.

Other objects become apparent from the preceding and following disclosure.

One or more objects of the invention are obtained by the invention as described herein, and as illustrated by the typical embodiments intended to improve understanding of the invention but not to unduly limit it since obvious modifications and substitution of equivalents are also intended.

Broadly the invention may be described as as a computer key-punch work-station structure of key board work shelf, and copy support shelf mounted variably in height and preferably also variable in tilt. In a further embodiment, there is provided a video display-screen support shelf behind each of the key board work shelf and the copy support shelf with the video display-screen support shelf being mounted variable in height and preferably also in tilt.

A preferred tilt arrangement for the copy support shelf is inclusive of a hinge mechanism at a rearward edge of the copy support shelf, such that raising solely the hinge-structure while maintaining unchanged the forward support results in an increased forward tilt of the copy support shelf. Also, however, one embodiment provides also for height-adjustment of the forward-edge of the copy support shelf, by repositioning upwardly or downwardly variably-mountable support elements, intermittently.

In the embodiment for variable elevation intermittently of the video display-screen support shelf, in one embodiment the rearward portion of the video display-screen support shelf is fixed to a constant height, while a forward portion is supported by a variably mounted support variable of the height of the forward portion whereby tilt and elevation are simultaneously adjustable for a monitor mounted on the video display-screen support shelf. Preferably, however, both the forward and rearward supports of the video display-screen support shelf are variable in height of the forward and rearward portions of the video display-screen support shelf. However, even with the embodiment having the fixed rearward height, there is great advantage in being able to independently maintain a constant rearward height while merely varying the tilt and angle of viewing by the key-punch worker, to avoid glare and/or to have a more advantageous view as dependent upon the size and position of the supported screen-monitor.

Because of the excessively large weight of typical commercial operation-screen monitors ranging up to 100 pounds or more for example, as previously noted, in a preferred embodiment having variable-height mounting elements mounted on an upright transversely-extending panel, structural stability to avoid cracks and breaks therein has been discovered to require that this panel be substantially free of any cut-outs of aperatures therein of any significant size. On the other hand, the utilization of this upright transversely-extending panel has been found to be the optimal arrangement to provide needed support strength for the large weight of the normally preferably forwardly-tilted video display-screen support shelf and screen-monitor supported thereon.

Accordingly, there preferably is provided a cord through-space aperature in a rearward portion of the key board work shelf, while thus avoiding any such aperature in the above-noted transversely-extending upright panel. The monitor support shelf has a large aperature therein for lead wires from the monitor.

Because of the large weight of the monitor, as previously noted, together with the weight and forward space requirements of each of the key board work shelf and key-punch machine mounted thereon, and the copy support shelf, there is a major inbalance inherent in such an arrangement, such inbalance resulting in an abnormal and hazardous stress on supporting leg structure; also equilibrium of the entire arrangements having all equipment mounted thereon has heretofore been inherently unstable and hazardous. Accordingly, as a result of considerable experimentation in design and testing, an improved leg support structure has been developed, namely on each of opposite side bilaterally, there is provided unified forward and rearward leg upright elements, preferably tubular, integrally interconnected at the base portions thereof. In a further preferred embodiment thereof, upper ends thereof are braced by connections to shelf-mounting structure to prevent lateral or sideward leaning or wobbling on and of the leg upright elements, provided that the bracing or anchoring points are at locations significant distances above the engaging lower portions of the shelf-mounting structure, such as bottom edges of paired spaced-apart side panels, a preferred arrangement of shelf and upright panel support structure.

In the preferred embodiment utilizing the paired spaced-apart upright side panels, weight-distributing horizontal supports are mounted along a base-portion (bottom-portion) of each side panel thereby providing needed reenforcement strength in light of the excessive stress already placed on these panels as a result of the mounting of all shelves and the transverse panel thereon together with the heavy monitor carried thereon. Preferably the horizontal supports are mounted on the side panels, and the side panels mounted on and supporting the other shelves and panels, etc.; however, the horizontal supports may be mounted onto the key board work shelf and the side panels also mounted on the key board work shelf, and possibly also to the horizontal supports.

The invention may be better understood by making reference to the drawings of the Figures as follow.

THE FIGURES

DETAILED DESCRIPTION

In greater detail, common indicia are utilized for the corresponding element in the different elements, to simplify understanding and following of the description, for basic similarities.

Figure 1:
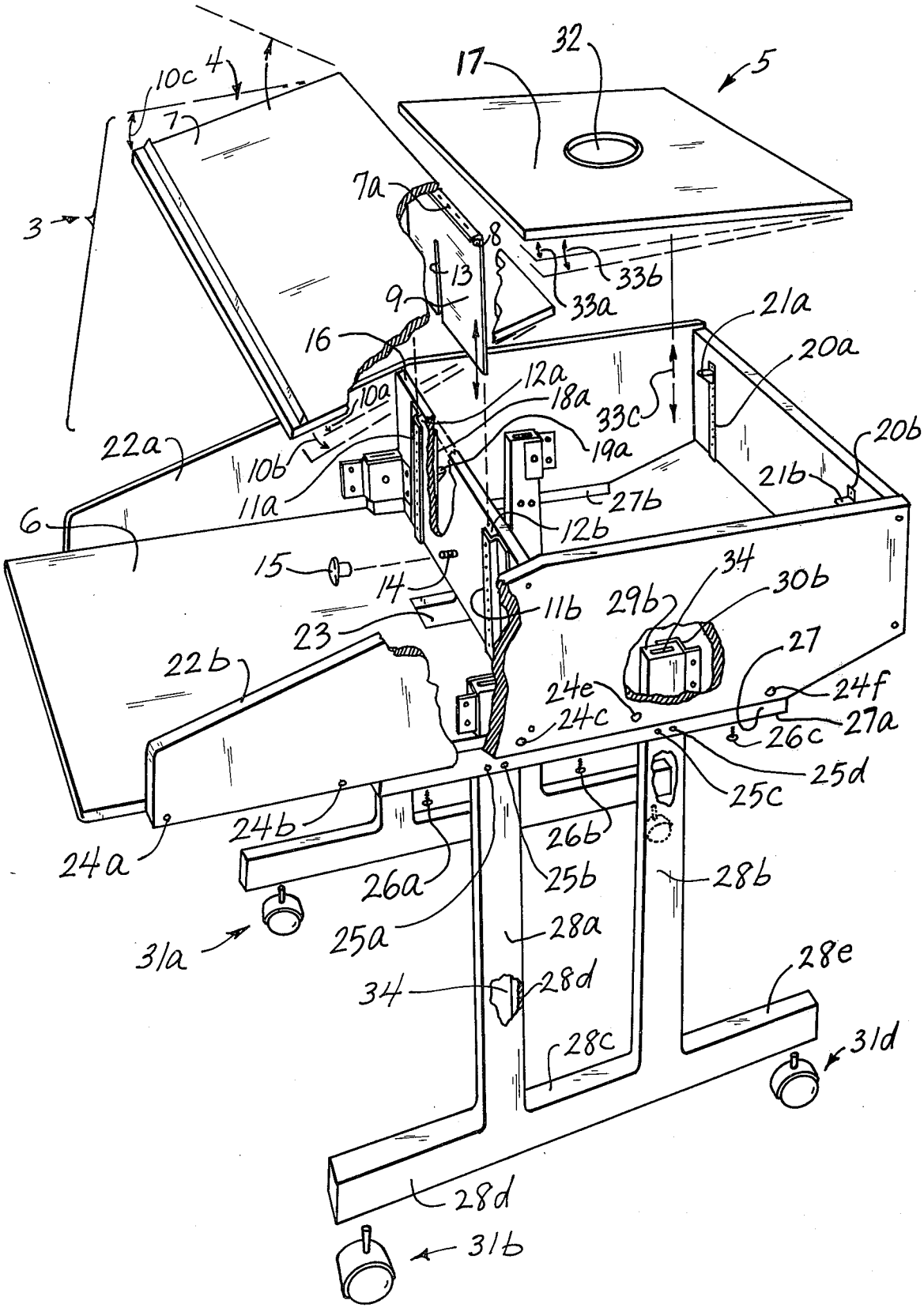
FIG. 1 illustrates a front and side perspective view of a preferred embodiment of a computer key-punch work-station of this invention, shown in partially exploded view and with partial cut-aways for purposes of improved illustration, as a structure.

In FIG. 1, work station structure 3 is broadly disclosed. For mounting visibly written material or the like to be copied on a computer in-put key-board, there is provided the copy support shelf combination 4 that includes the shelf 7 and a rearwardly-positioned support bracket 7a mounted on hinge 8 which hinge 8 is mounted on the vertical adjustment slotted-plate 9 having slot 13 therein. The vertical adjustment slotted-plate 9 is inserted downwardly into slide-spaces 12a and 12b of z-brackets 11a and 11b, whereby the vertical adjustment slotted-plate is adjustable optionally intermittently upwardly and downwardly on male-threaded key 14 prior to locking into a set-position by the tightening of the screw-knob 15 (female-threaded) onto the key 14. Accordingly the height of the rearward portion of the shelf 7 is intermittently variable, while when at rest, the forward portion of the shelf 7 rests on the top surfaces of side-support members 22a and 22b, resulting in a varying of the amount of tilt of the shelf 7 by a varying of the height that the vertical adjustment slotted-plate 9 as afore-stated.

The copy support shelf 7 when at rest at its forward portion, overhangs and is spaced above a rearward portion of the key board work shelf 6. A computer key board lead outlet aperature or hole is provided in the rearward portion of the key board work shelf, here illustrated as hole 23. The computer key board normally rests solely on the forward portion of the key board work shelf, thus leaving a storage space on the upper surface of the rearward portion of the key board work shelf beneath the overhanging copy support shelf. When the computer key board is in place, in order to make that space accessible readily, the hinge 8 provides the mechanism for lifting the copy support shelf's forward edge in the nature of an access lid or door to the storage space thereby provided. By having the hinge located at the rearward edge of the copy support shelf, together with advantages previously noted of thus controlling and making variable the tilt of the copy support shelf, additionally such arrangement makes it very convenient for the worker to gain ready access to such storage space with a minimum of effort, as compared to other alternate entries to this space, if any. Thus, the copy work shelf is movable upwardly along arc 10c, or to resting place through arc 10a or 10b, depending upon the height adjustment of the plate 9.

Accordingly, the transversely-extending upright panel 16 mounts the z brackets 11a and 11b which in turn mount the plate that by hinge 8 supports the copy support shelf 7. The panel 16 is securely mounted between side supports 22a and 22b, and adds considerable stability to the entire structure by its transverse bracing. This panel also supports the greater amount of weight of a monitor when a monitor is mounted on a downward tilted (normally) video display-screen support shelf (or monitor support shelf) 17, by height-adjustable elements 19a and 19b (not shown) and 21a and 21b which are respectively mounted of the height-element-mounting tracks 18a, 18b (not shown), 20a and 20b. Note that element 19b is identical to the element 19a, and the track 18b is identical to the element 18a, thus not requiring specific illustration. Accordingly, considerable weight and strain and stress is carried by the panel 9. During development, it was found that placement of lead aperatures and/or mounting slots, or the like resulted in such major weakening of the panel that considerable panel breakage and/or rupture was experienced, whereby it was found that this paney must be substantially free of any large aperatures, slots, or the like.

Likewise because similar major stresses were found to be placed on the side panels 22a and 22b, that a major and significantly large degree of added strength and overall stability for non-hazardous and steady (nonwobbling) support was added and achieved by the utilization of a leg-support element on each of opposites, mounted as leg-support elements 27*a* and 27*b* on leg elements 28*a* and 28*b*, and leg elements 27*a* and 27*b*, and as illustrated preferably fastened to a lower (bottom) face of the side panels 22*a* and 22*b*, extending substantially horizontally, whereby weight of other mounted structure and of the monitor eventually mounted thereon is widely-distributed, thus reducing critical strain on any one part of the side panels 22*a* and 22*b*. Typically, the leg-support elements are mounted by screws 26*a*, 26*b*, 26*c*, and the like, on each of the opposite sides. Likewise, typically the leg-support elements 27 (broadly) are mounted on the leg elements by brads or screws 25*a*, 25*b*, or the like.

To further add stability, the prior experimental single leg on each side was in the FIG. 1 embodiment replaced by the far supperior arrangement of spaced-apart leg elements 28*a* and and 28*b*, for example, with the preferred anchoring-together at their bases by the link-structure 28 making the entire leg-supports a unitary fixed-state structure thus providing bracing against spreading or otherwise weakening leg-strains. To prevent side-wobbling, there is provided the leg elements extending well-above the levels of the leg support elements 27, and at a top portion of each leg element at about locations 29*a*, 29*b*, and the like, there is provided bracket structures locking the leg elements against the side panels 22*a* and 22*b*, preventing wobbling in any direction, by brackets 30*a*, 30*b* and the like.

While the shoring-up and improved strength stability is very important as above noted, also it is desirable to maintain a desirably light-weight over-all structure. Accordingly, all leg-elements and the link-structure 28 are tubular light-weight metal or alloy.

As with conventional structures, caster rollers 31*a* through 31*d* are provided. Tubular spaces 34 are illustrated also.

With regard to the monitor-support shelf 17, it is illustrated typical varying angles of tilt 33*a* and 33*b* that may be achieved, to vary the normally-forward tilt. However, also the overall height may be varied in directions 33*c*, upwardly or alternately downwardly.

Figure 2:
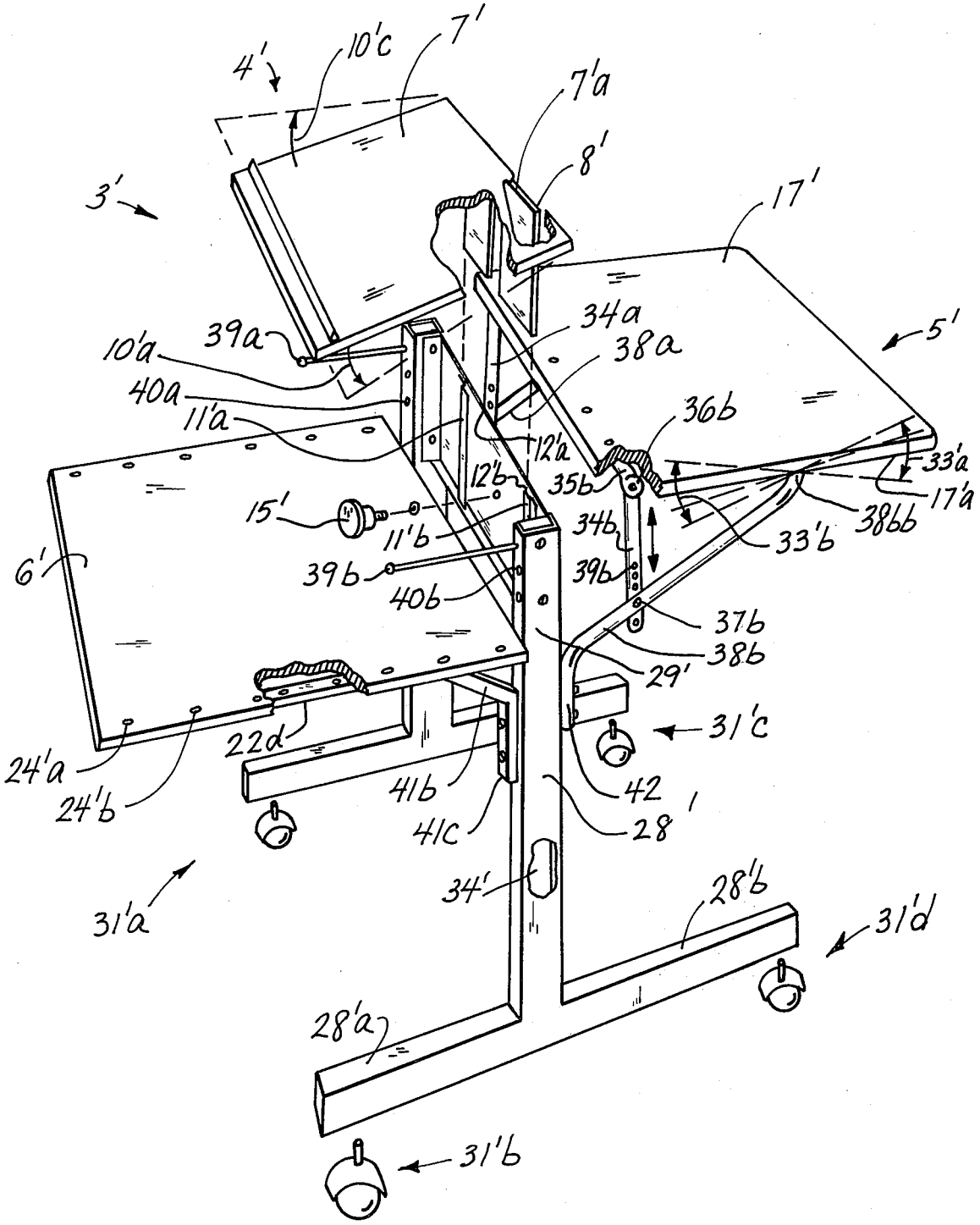
FIG. 2 illustrates a similar view of an alternate embodiment of the computer key-punch work-station structure.

With regard to FIG. 2, many elements are the same. This embodiment is intended for smaller-industry use where monitors are not so very large, and where investment may be necessarily held to a minimum for purchases in such industries, this economy model being more than adequate for some purposes as theres above-noted smaller monitor users. While the corresponding elements will not be again described, it is noted that here there is an additional feature that also the forward support elements 39*a* and 39*b* have alternate mounting holes 40*a* and 40*b* at different heights, such that a common (same) tilt may be maintained for the copy support shelf 7' while adjusting its height. Also in this embodiment, solely the forward portion of the video-screen display support shelf 17' (monitor support shelf) may be raised or lowered intermittently, solely to adjust forward tilt, however it being the forward tilt that is the matter of major importance normally for the monitor-support shelf. The monitor-support shelf is adjustable by lowering or raising the upright members 34*a* and 34*b* to adjust the pins 37*a* (not shown) or identical 37*b*, on the support arm 38*a* anchored at its base 42. The upper portion 39*bb* of the support arm 38*a* supports the lower face 17'*a* of the monitor-support shelf 17'. The upright members 34*a* and 34*b* have alternate mounting holes 39*b*, for example. It should be noted, however, that even though there is solely a forward adjustment, by sufficient raising of the upright members 34*a* and 34*b*, the monitor support shelf may be tilted rearwardly(-backwardly) forward and backward tilts being illustrated by arcs 33'*b* and 33'*a*. Tilt is provided by a hinge-pin 36*a* and 36*b*, identical pins at opposite ends of the shelf-support 35*b*.

The computer key board shelf 6' is supported on forwardly-extending horizontal support 22*d*, for example, one on each of opposite sides, typically mounted by screws 23'*a*, 24'*b* or the like.

While there is solely a single leg element 28' on each of the opposite sides, and other differences for FIG. 1 embodiment, it is noted that for this embodiment there is equilibrium stability added by the rearward horizontal leg elements 28'*b* being substantially longer than the forwardly-extending leg elements 28'*a*, since the heavy monitor will be supported rearwardly on the monitor-support shelf 17'.

It is within the scope of this invention to make variations and modifications and substitutions within the skill of an artisan in this field.

We claim:

1. A computer key-punch work-station structure comprising in combination: a keyboard work shelf, two spaced-apart side panels mounted bilaterally on each of opposite edges of the keyboard work shelf, a copy support shelf, and a copy support shelf-mounting means for mounting said copy support shelf on and between said two spaced-apart side panels and elevated above said keyboard work shelf, said copy support shelf being mounted with its forward and rearward portions spaced-above said keyboard work shelf a predetermined distance sufficient for providing a storage space on a rearward portion of the keyboard work shelf below the copy support shelf, and a forward edge of the copy support shelf being spaced rearwardly of a forward edge of the keyboard work shelf a predetermined distance sufficient for resting a computer keyboard on a forward portion of the keyboard work shelf at a location not substantially beneath the copy support shelf, and height adjustment means for intermittent adjustment of a rearward portion of the copy support shelf at different heights, and a video display-screen support shelf, and video display-screen support shelf-mounting means for mounting said video display-screen support shelf in juxtaposition to and rearwardly of said copy support shelf and said keyboard work shelf, and video-shelf adjustment means for intermittent adjustment of the video display-screen support shelf at different heights, said copy support shelf being forwardly inclined.

2. A computer key-punch work-station structure of claim 1, in which said video display-screen support shelf-mounting means includes tilt-adjustment means for intermittently adjusting forward-to-rearward tilt of the video display-screen support shelf.

3. A computer key-punch work-station structure of claim 2, in which said tilt adjustment means and said video-display screen support-shelf means include separate forward and rearward shelf-support elements separately adjustable of height.

4. A computer key-punch work-station structure of claim 3, including aperature-forming structure forming a through-channel aperature in a rearward portion of said keyboard work shelf and said upright panel being devoid of any aperature of a predetermined size sufficiently large to substantially weaken support strength of said upright panel, and said forward shelf-support element being mounted on said upright panel.

5. A computer key-punch work-station structure of claim 1, in which said video display-screen support shelf-mounting means includes tilt-adjustment means for intermittently adjusting forward-to-rearward tilt of the video display-screen support shelf.

6. A computer key-punch work-station structure of claim 5, in which said copy support shelf-mountintg means includes a substantially upright panel mounted transversly between and on said two spaced-apart side panels, in which said hinge is height-adjustably mounted on said upright panel, in which said tilt adjustment means and said video-display screen support-shelf means includes separate forward and rearward shelf-support elements separately adjustable of height, and aperature-forming structure forming a through-channel aperature in a rearward portion of said key board work shelf, said upright panel being devoid of any aperature of a predetermined size sufficiently large to substantially weaken support strength of said upright panel, and said forward shelf-support element being mounted on said upright panel.

7. A computer key-punch work-station structure of claim 1, including leg-support means for supporting and suspending in space at least one of said key board work shelf and said two spaced-apart side panels, said leg-support means including spaced-apart side-leg elements positioned substantially uprightly, and stress-distributing support structure mounted on said one, and the remaining other one of said key board work shelf and said two spaced-apart side panels being mounted on said one.

8. A computer key-punch work-station structure of claim 4, including leg-support means for supporting and suspending in space at least one of said keyboard work shelf and said two spaced-apart side panels, said leg-support means including spaced-apart side-leg elements positioned substantially uprightly, and the remaining other one of said keyboard work shelf and said two spaced-apart side panels being mounted on said one.

9. A computer key-punch work-station structure comprising in combination: a keyboard work shelf having an unobstructed upper surface receivable of a computer keyboard and having a forwardly extending portion thereof freely accessible to a computer keyboard operator, a copy support shelf, a copy support shelf-mounting means for mounting said copy support shelf at an elevation above said keyboard work shelf, said copy support shelf being mounted forwardly inclined with its forward and rearward portions spaced-above said keyboard work shelf a predetermined distance sufficient for providing storage space on a rearward portion of the keyboard work shelf below the copy support shelf, and a forward edge of the copy support shelf being spaced rearwardly of a forward edge of the keyboard work shelf a predetermined distance sufficient for resting a computer keyboard on a forward portion of the keyboard work shelf at a location not substantially beneath the copy support shelf; and a video display-screen support shelf, and video display-screen support shelf-mounting means for mounting said video display-screen support shelf in juxtaposition to and rearwardly of said copy support shelf and said keyboard work shelf, and height adjustment means for intermittent adjustments of forward and rearward portions of said video display-screen support shelf such that both height and tilt of the video display-screen support shelf are variable intermittently.

10. A computer key-punch work-station structure of claim 9, in which the video display-screen support shelf-mounting means further provides for intermittent height adjustment of a rearward portion of the video display-screen support shelf.

11. A computer key-punch work-station structure of claim 9, including an aperature-forming structure forming an aperature through the video display-screen support shelf, the aperature therein being of a predetermined size sufficiently large for passage therethrough of lead wires from a video display-screen monitor, and positioned to receive lead wires from a video display-screen monitor.

* * * * *